US009354558B1

(12) United States Patent
Ota et al.

(10) Patent No.: US 9,354,558 B1
(45) Date of Patent: May 31, 2016

(54) IMAGE FORMING APPARATUS AND IMAGE FORMING METHOD

(71) Applicant: FUJI XEROX CO., LTD., Tokyo (JP)

(72) Inventors: Naoki Ota, Kanagawa (JP); Katsuyuki Kitajima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/948,807

(22) Filed: Nov. 23, 2015

(30) Foreign Application Priority Data

May 29, 2015 (JP) ..... 2015-110343

(51) Int. Cl.
*G03G 15/00* (2006.01)
*G03G 15/16* (2006.01)

(52) U.S. Cl.
CPC ..... *G03G 15/1605* (2013.01)

(58) Field of Classification Search
CPC ..... H01B 3/40; C08K 3/28; C08K 2003/222; C08K 3/22; C08K 2003/2227; C09K 5/14; G03G 9/0812–9/09725; G03G 15/1605
See application file for complete search history.

(56) References Cited

U.S. PATENT DOCUMENTS 6,957,032 B2 * 10/2005 Takahata ..... G03G 9/0821 399/302
7,056,638 B1 6/2006 Tomita et al.
2001/0005461 A1 * 6/2001 Ichikawa ..... G03G 15/0126 399/281
2002/0106574 A1 * 8/2002 Haneda ..... G03G 9/0827 430/124.1
2004/0265726 A1 * 12/2004 Yamazaki ..... G03G 15/16 430/125.3
2009/0029278 A1 * 1/2009 Op De Beeck ..... G03G 9/081 430/108.4
2010/0183968 A1 * 7/2010 Sugawara ..... G03G 9/08782 430/108.1
2012/0189851 A1 * 7/2012 Zenitani ..... G03G 9/0812 428/404
2013/0315612 A1 11/2013 Nishisaka et al.
2014/0308611 A1 * 10/2014 Shimano ..... G03G 9/08755 430/109.4
2015/0044601 A1 * 2/2015 Taguchi ..... G03G 9/0819 430/105
2015/0072277 A1 * 3/2015 Sugiura ..... G03G 9/0819 430/105
2015/0072286 A1 * 3/2015 Kumai ..... G03G 9/08755 430/109.4
2015/0165745 A1 * 6/2015 Kweon ..... D04H 1/58 442/64

(Continued)

FOREIGN PATENT DOCUMENTS

JP 2004-145243 A 5/2004
JP 2010-139603 A 6/2010

(Continued)

*Primary Examiner* — Clayton E LaBalle
*Assistant Examiner* — Ruifeng Pu
(74) *Attorney, Agent, or Firm* — Sughrue Mion, PLLC

(57) ABSTRACT

An image forming apparatus includes a developing unit that develops an electrostatic charge image formed on an image holding member with a developer containing a toner, an intermediate transfer member, and a guide unit that guides at least one of the image holding member and the intermediate transfer member to a primary transfer position to cause a portion of the surface of the image holding member and a portion of the surface of the intermediate transfer member to follow each other, wherein the toner has a sea and island structure of a sea portion containing a binder resin and an island portion containing a release agent, and has a maximum frequent value in distribution of eccentricity B of the island portion containing the release agent and a skewness in the distribution of eccentricity B each falling within the specific ranges as described in the specification.

12 Claims, 4 Drawing Sheets

(56) References Cited

U.S. PATENT DOCUMENTS

2015/0192872 A1* 7/2015 Noguchi ..... G03G 9/0902
430/105
2015/0198901 A1* 7/2015 Nozaki ..... G03G 9/0819
430/108.4
2015/0227069 A1* 8/2015 Sugama ..... G03G 9/08733
430/109.4
2016/0004179 A1* 1/2016 Sugimoto ..... G03G 9/08755
430/105
2016/0042831 A1* 2/2016 Kotani ..... H01B 3/40
252/75

FOREIGN PATENT DOCUMENTS

JP 2011-158758 A 8/2011
JP 2013-246253 A 12/2013

* cited by examiner

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-110343 filed May 29, 2015.

BACKGROUND

1. Technical Field

The present invention relates to an image forming apparatus and an image forming method.

2. Related Art

Formation of an image by using an electrophotographic technology is performed as follows. The entirety of a surface of a photoreceptor is charged, and then the surface of the photoreceptor is exposed by using laser beams in accordance with image information so as to form an electrostatic latent image on the surface of the photoreceptor. Then, the formed electrostatic latent image is developed by using a developer containing a toner, and thus a toner image is formed. At last, the formed toner image is transferred onto a surface of a recording medium and then fixing is performed.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that stores a developer containing a toner and develops the electrostatic charge image formed on the surface of the image holding member so as to form a toner image;

an intermediate transfer member onto a surface of which the toner image is transferred;

a primary transfer unit that primarily transfers the toner image formed on the surface of the image holding member onto the surface of the intermediate transfer member;

a secondary transfer unit that secondarily transfers the toner image transferred onto the surface of the intermediate transfer member onto a surface of a recording medium; and a guide unit that is provided on an upstream side of the primary transfer unit in a rotation direction of the intermediate transfer member, and guides at least one of the image holding member and the intermediate transfer member to a primary transfer position by the primary transfer unit so as to cause a portion of the surface of the image holding member and a portion of the surface of the intermediate transfer member to follow each other, wherein the toner contains a binder resin, a colorant, and a release agent and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B = 2d/D \quad (1)$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

BRIEF DESCRIPTION OF THE DRAWINGS

Exemplary embodiments of the present invention will be described in detail based on the following figures, wherein.

DETAILED DESCRIPTION

Figure 1:
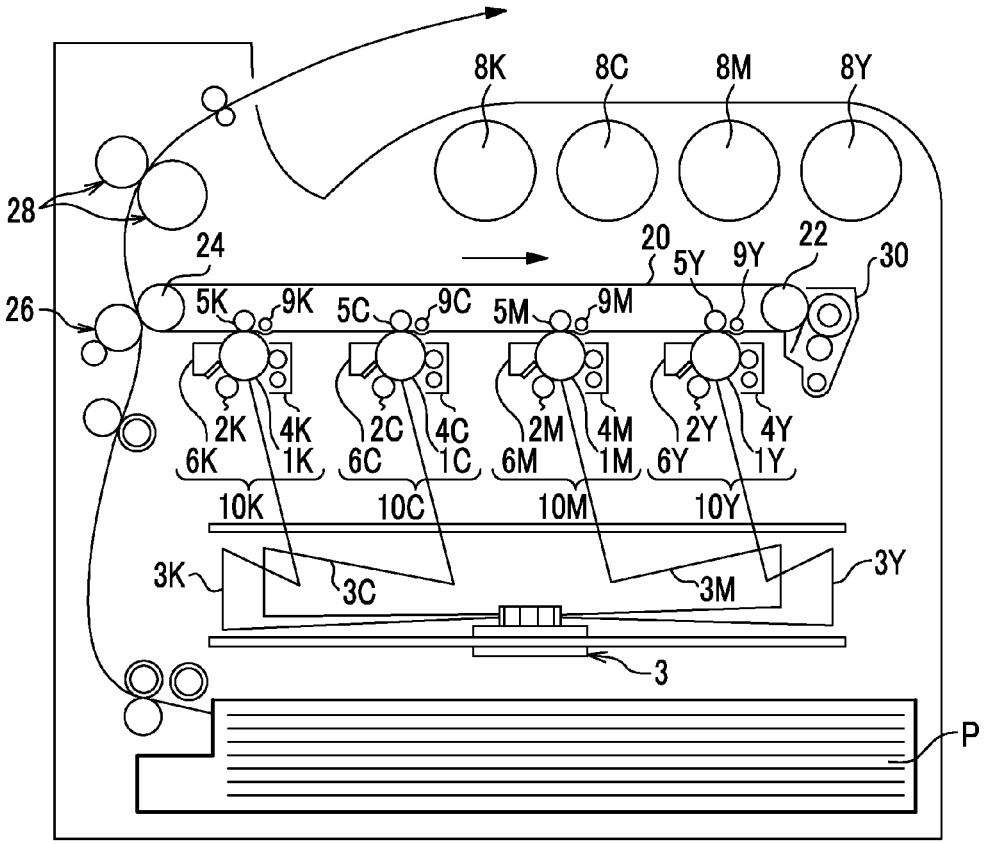
FIG. 1 is a schematic configuration diagram illustrating an example of an image forming apparatus according to this exemplary embodiment.

Hereinafter, an exemplary embodiment which is an example of the invention will be described in detail.

Image Forming Apparatus/Image Forming Method

An image forming apparatus according to this exemplary embodiment includes an electrophotographic photoreceptor (which may be simply referred to as a "photoreceptor" below), a charging unit, an electrostatic latent image forming unit, a developing unit, an intermediate transfer member, a primary transfer unit, a secondary transfer unit, and a guide unit. The charging unit charges a surface of the electrophotographic photoreceptor. The electrostatic latent image forming unit forms an electrostatic latent image on the charged surface of the electrophotographic photoreceptor. The developing unit stores a developer including a specific toner (which will be described later), and develops the electrostatic latent image formed on the surface of the electrophotographic photoreceptor by using the developer so as to form a toner image. A toner image is transferred onto a surface of the intermediate transfer member. The primary transfer unit primarily transfers the toner image formed on the surface of the electrophotographic photoreceptor onto the surface of the intermediate transfer member. The secondary transfer unit secondarily transfers the toner image transferred onto the surface of the intermediate transfer member onto a surface of a recording medium. The guide unit is provided on an upstream side of the primary transfer unit in a rotation direction of the intermediate transfer member, and guides at least one of the electrophotographic photoreceptor and the intermediate transfer member to a primary transfer position by the primary transfer unit so as to cause a portion of the surface of the electrophotographic photoreceptor and a portion of the surface of the intermediate transfer member to follow each other.

It is known that an intermediate transfer image forming apparatus of the related art includes a guide unit which causes the electrophotographic photoreceptor on which a toner image is formed and the intermediate transfer member to follow each other with the toner image interposed between the electrophotographic photoreceptor and the intermediate transfer member before the primary transfer, that is, before a primary transfer voltage is applied, from a viewpoint of prevention of flying and scattering of a toner in primarily transferring.

In the image forming apparatus including such a guide unit, a state where the electrophotographic photoreceptor and the intermediate transfer member contact each other through the toner image occurs during a period of time from before the primary transfer until the primary transfer is performed. In this manner, a period of time when the intermediate transfer member and the toner image maintain contact therebetween is longer than that in a case where the guide unit is not included. Thus, adhering of the toner to the surface of the intermediate transfer member, that is, filming on the intermediate transfer member may occur when the intermediate transfer member has a high temperature, and in addition, when the toner has a high temperature.

The high temperature of the intermediate transfer member is caused by contact between a sheet (particularly, thick sheet) which has a high temperature due to double-sided printing, and the intermediate transfer member, in many cases. The high temperature of the toner is caused by keeping a toner in a developing unit in a high temperature state, for example, in a summer vacation, or the like, in many cases.

In order to prevent occurrence of the filming on the intermediate transfer member, for example, a method of increasing a content of a release agent in a toner is exemplified. The release agent is vaporized (volatilized) by heat and then is cooled in the image forming apparatus to thereby be solidified. Thus, coarse particulates may be formed. If a content of the release agent in the toner is simply increased, for example, the amount of the exposed release agent on a surface of the toner is increased, so that the amount of the coarse particulates may be increased.

Accordingly, a method of preventing the filming on the intermediate transfer member without an increase of the content of the release agent in the toner with respect to the toner in which the release agent is contained only in the inside is desired.

The image forming apparatus according to this exemplary embodiment is an image forming apparatus including the developer which contains the specific toner which will be described later.

The specific toner contains a binder resin, a colorant, and a release agent, and has a sea and island structure of a sea portion containing the binder resin and an island portion containing the release agent. A maximum frequent value in distribution of the following eccentricity B of the island portion containing the release agent is in a range of from 0.75 to 0.95, a skewness in the distribution of the following eccentricity B is in a range of from −1.10 to −0.50, and the eccentricity B is represented by the following expression (1):

$$\text{Eccentricity } B = 2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

The eccentricity B of the island portion containing the release agent (also referred to as a "release agent domain" below) in the specific toner is an index indicating a distance of the centroid of the release agent domain from the centroid of the toner. A larger value of the eccentricity B indicates that the release agent domain exists closer to the surface of the toner. A smaller value of the eccentricity B indicates that the release agent domain exists closer to the center of the toner. The maximum frequent value in the distribution of the eccentricity B indicates a portion at which the release agent domain exists in the largest amount in a radial direction of the toner. The skewness of the distribution of the eccentricity B indicates bilateral symmetry of the distribution. Specifically, the skewness of the distribution of the eccentricity B indicates a degree of unevenness from the maximum frequent value in the distribution. That is, the skewness of the distribution of the eccentricity B indicates a degree of the distribution of the release agent domain from the portion where the release agent domain exists in the largest amount in the diameter direction of the toner.

Figure 4:
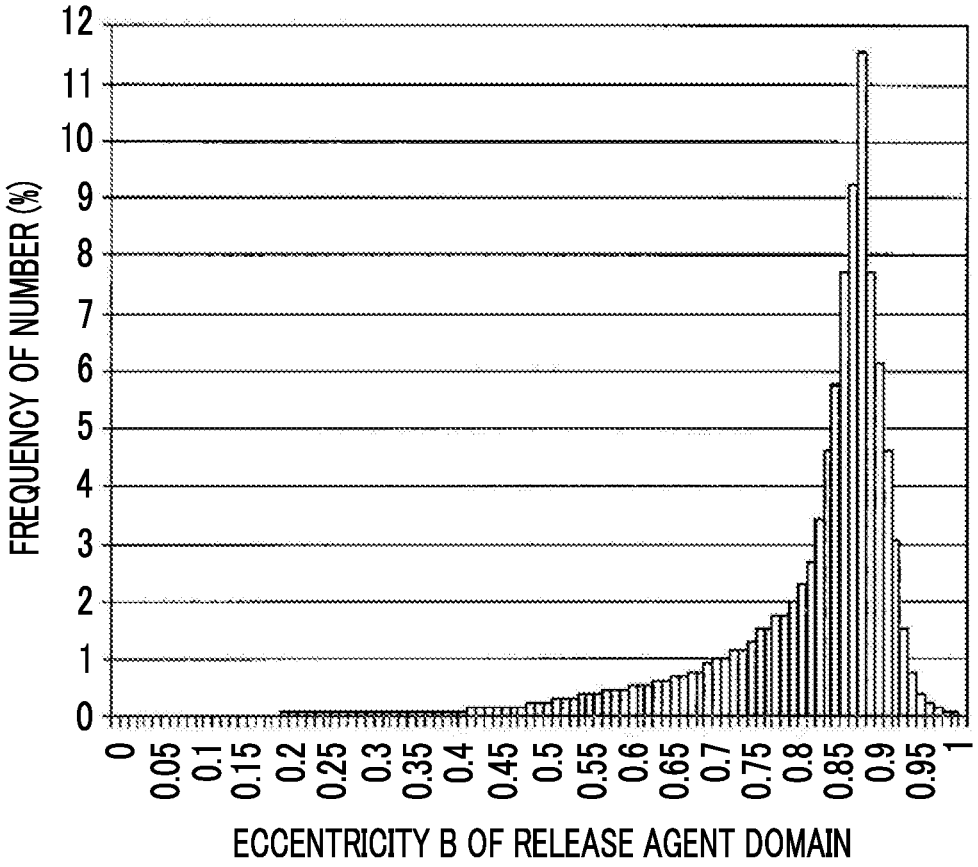
FIG. 4 is a diagram illustrating an example of distribution of eccentricity B of a release agent domain in a toner according to this exemplary embodiment.

That is, the maximum frequent value in the distribution of the eccentricity B of the release agent domain being in a range of from 0.75 to 0.95 means that the release agent domain exists in the largest amount at a position close to a surface layer portion of the toner. The skewness of the distribution of the eccentricity B of the release agent domain being in a range of from −1.10 to −0.50 means that the release agent domain is distributed inwardly from the surface layer portion of the toner with a gradient (see FIG. 4).

In this manner, the specific toner in which the maximum frequent value and the skewness of the distribution of the eccentricity B of the release agent domain respectively satisfy the above-described ranges is a toner in which the release agent domain exists in the largest amount in the vicinity of the surface layer portion and is distributed to the vicinity of the surface layer portion from the inside of the toner with a gradient. The toner having such a gradient for the distribution of the release agent domain has properties that the release agent which is close to the surface layer portion of the toner easily bleeds at low pressure, and if it receives high pressure, the release agent in the inside of the toner as well as the release agent close to the surface layer portion of the toner bleeds. That is, regarding the toner having a concentration gradient of the release agent domain, the amount of bleeding of the release agent is controlled in accordance with pressure.

If low pressure is applied to the specific toner having the properties by the specific cleaning unit and the like, a portion of the release agent close to the surface layer portion of the toner bleeds and thus the release properties appear and occurrence of photoreceptor filming is prevented. Since the release agent is also contained in the inside of the specific toner in addition to the vicinity of the surface layer portion, excessive bleeding of the release agent when low pressure is applied is prevented.

When fixing is performed, high pressure is applied to the specific toner. Thus, the release agent in the inside of the toner bleeds besides the release agent close to the surface layer portion of the toner. Accordingly, the release properties are shown sufficiently.

Here, from a viewpoint of prevention of the filming on the intermediate transfer member, a toner in which the release agent exists only at the surface layer portion may be provided. However, in this toner, it is considered that the amount of the release agent exposed on a surface of the toner is increased and the number of the coarse particulates is increased. In a case of the toner in which the release agent exists only at the surface layer portion, meltability of the toner may be deteriorated and fixation defect may be caused when fixing is performed.

As described above, the image forming apparatus according to this exemplary embodiment includes the specific toner having the concentration gradient in the release agent domain and thus it is possible to ensure release properties in fixing and to prevent filming on the intermediate transfer member.

Particularly, the specific toner having the concentration gradient in the release agent domain causes no need for increasing the content of the release agent for the toner containing the release agent only in the inside of the toner. Thus, the coarse particulates formed due to the release agent hardly increase.

Flying and scattering of a toner in primarily transferring may be prevented and an image having high quality may be formed by the above-described image forming apparatus including the guide unit.

In the image forming apparatus according to this exemplary embodiment, an image forming method (image forming method according to this exemplary embodiment) is performed. The image forming method includes a charging process, an electrostatic latent image forming process, a developing process, a primary transfer process, a secondary transfer process, and a guide process. In the charging process, the surface of the electrophotographic photoreceptor is charged. In the electrostatic latent image forming process, an electrostatic latent image is formed on the charged surface of the electrophotographic photoreceptor. In the developing process, the electrostatic latent image formed on the surface of the electrophotographic photoreceptor is developed by using the developer containing the specific toner and thereby a toner image is formed. In the primary transfer process, the toner image formed on the surface of the electrophotographic photoreceptor is primarily transferred onto the surface of the intermediate transfer member. In the secondary transfer process, the toner image which has been transferred onto the surface of the intermediate transfer member is transferred onto a surface of a recording medium. In the guide process, the portion of the surface of the electrophotographic photoreceptor on which the toner image is formed and the portion of the surface of the intermediate transfer member are caused to follow each other through the toner image interposed between the electrophotographic photoreceptor and the intermediate transfer member to the primary transfer position by the primary transfer unit.

Configuration of Image Forming Apparatus

The configuration of the well-known image forming apparatus is applied to the image forming apparatus according to this exemplary embodiment. Examples of the well-known image forming apparatus include an apparatus including a fixing unit that fix a toner image transferred on a recording media; an apparatus including an erasing unit that performs erasing by irradiating a surface of an electrophotographic photoreceptor with eraser light after transferring of a toner image and before charging; an apparatus including a cleaning unit that cleaning a surface of an elecrophotographic photoreceptor after transferring of a toner image and before charging; an apparatus including an electrophotographic photoreceptor heating member for increasing the temperature of an electrophotographic photoreceptor so as to reduce the relative temperature.

In the image forming apparatus according to this exemplary embodiment, for example, a part at which the electrophotographic photoreceptor is included may be a cartridge structure (process cartridge) which is detachable from the image forming apparatus. This process cartridge may include, for example, at least one unit selected from a group of the charging unit, the electrostatic latent image forming unit, and the developing unit in addition to the electrophotographic photoreceptor.

An example of the image forming apparatus according to this exemplary embodiment will be described below. However, it is not limited thereto. Main components illustrated in the drawings will be described and descriptions of other components will be omitted.

FIG. 1 is a schematic configuration diagram illustrating the image forming apparatus according to this exemplary embodiment.

The image forming apparatus illustrated in FIG. 1 includes first to fourth electrophotographic image forming units 10Y, 10M, 10C, and 10K (image forming units) that respectively print yellow (Y), magenta (M), cyan (C), and black (K) images based on color-separated image data. These image forming units (which may be simply referred to as "units" below) 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing so as to extend through the units. The intermediate transfer belt 20 is wound on a driving roller 22 and a support roller 24 contacting the inner surface of the intermediate transfer belt 20, which are separated from each other on the left and right sides in the drawing, and the intermediate transfer belt 20 travels in a direction toward the fourth unit 10K from the first unit 10Y. A force is applied to the support roller 24 in a direction in which it departs from the driving roller 22 by a spring or the like (not illustrated), and a tension is applied to the intermediate transfer belt 20 wound on both of the rollers. In addition, an intermediate transfer member cleaning device 30 is provided on a surface of the intermediate transfer belt 20 on the photoreceptor side so as to face the driving roller 22.

The developers including toners of four colors are respectively stored in developing devices (one example of developing units) 4Y, 4M, 4C, and 4K of the units 10Y, 10M, 10C, and 10K. Further, a yellow toner, a magenta toner, a cyan toner, and a black toner contained in toner cartridges 8Y, 8M, 8C, and 8K are respectively supplied to the developing devices 4Y, 4M, 4C, and 4K.

The first to fourth units 10Y, 10M, 10C, and 10K have the same configuration. Thus, only the first unit 10Y that is disposed on the upstream side in a traveling direction of the intermediate transfer belt and forms a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y includes a photoreceptor 1Y.

Here, a rotation speed of the photoreceptor 1Y (that is, a speed of moving of a surface of the photoreceptor 1Y) is set in accordance with the type of an image to be formed or the type of a recording medium, and the like. However, from a viewpoint that image formation at a high speed is required, the rotation speed of the photoreceptor 1Y is preferably equal to or higher than 300 mm/s, is more preferably equal to or higher than 500 mm/s, and is further preferably in a range of from 500 mm/s to 750 mm/s.

When it is such a high rotation speed, in the case of both sides printing, sheet of one side will be already conveyed as a high temperature after an image formation of one side. As a result, a filming is easy to happen, but this example embodiment can control a filming by using a developer containing a specific toner.

Around the photoreceptor 1Y, a charging roll (an example of the charging unit) 2Y, an exposure device (an example of the electrostatic charge image forming unit) 3, a developing device (an example of the developing unit) 4Y, a guide roll (an example of the guide unit) 9Y, a primary transfer roll (an example of the primary transfer unit) 5Y, and a photoreceptor cleaning device (an example of the cleaning unit) 6Y are arranged in sequence. The charging roll 2Y charges a surface of the photoreceptor 1Y to a predetermined potential. The exposure device 3 exposes the charged surface with laser beams 3Y based on a color-separated image signal to form an electrostatic charge image. The developing device 4Y supplies a charged toner to the electrostatic charge image to develop the electrostatic charge image and form a toner image. The guide roll 9Y cause the portion of the surface of the intermediate transfer belt 20 to follow the portion of the surface of the electrophotographic photoreceptor on which a toner image is formed, with the toner image interposed between the intermediate transfer belt 20 and the electrophotographic photoreceptor. The primary transfer roll 5Y applies a primary transfer voltage and primarily transfers the toner image interposed between the photoreceptor 1Y and the intermediate transfer belt 20 onto the intermediate transfer belt 20. The photoreceptor cleaning device 6Y removes the residual substances remaining on the surface of the photoreceptor 1Y after primary transfer.

The primary transfer roller 5Y is disposed inside the intermediate transfer belt 20 to be provided at a position facing the photoreceptor 1Y. Bias supplies (not illustrated) that apply a primary transfer bias are respectively connected to the primary transfer rollers 5Y, 5M, 5C, and 5K. Each of the bias supplies changes a transfer bias that is applied to each of the primary transfer rollers under the control of a controller (not illustrated).

The guide roll 9Y is disposed on the inside of the intermediate transfer belt 20. The guide roll 9Y deforms a portion of the intermediate transfer belt 20 so as to cause the portion of the surface of the intermediate transfer belt 20 to follow the portion of the surface of the photoreceptor 1Y.

Figure 2:
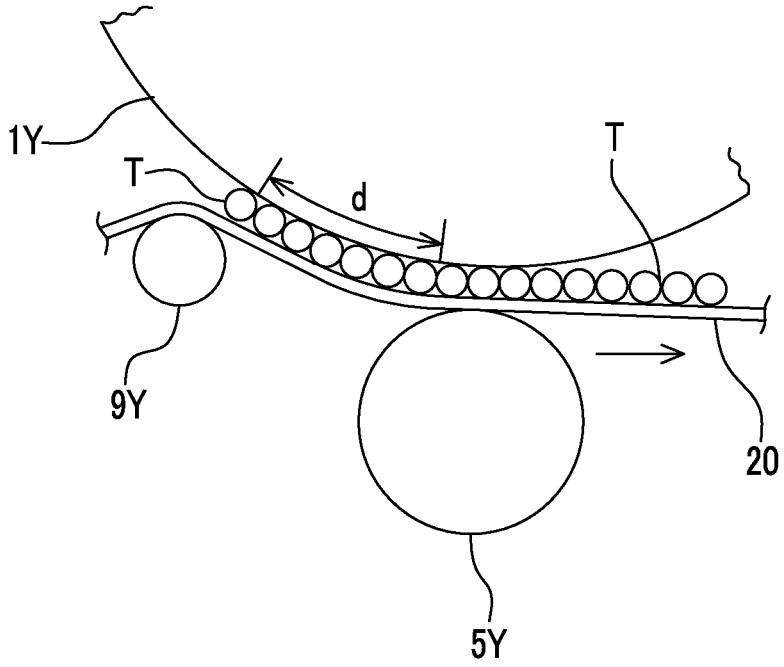
FIG. 2 is a schematic configuration diagram illustrating an arrangement of a guide unit in this exemplary embodiment.

An example of the arrangement of the guide unit will be described in more detail with reference to FIG. 2. FIG. 2 is a schematic configuration diagram illustrating the arrangement of the guide roll 9Y in the image forming unit 10Y.

As illustrated in FIG. 2, the guide roll 9Y is disposed on an upstream side of the primary transfer roll 5Y in an upstream side of the intermediate transfer belt 20 in the rotation direction (upstream side in a direction of an arrow in FIG. 2). The guide roll 9Y deforms the intermediate transfer belt 20 so as to follow a portion of an outer circumference of the photoreceptor 1Y. At this time, a developed toner image T is interposed between the photoreceptor 1Y and the intermediate transfer belt 20, and heat of the intermediate transfer belt 20 is transferred to the toner image T.

A distance between the portion of the surface of the photoreceptor 1Y and the portion of the surface of the intermediate transfer belt 20 which are caused to follow each other (d in FIG. 2: distance obtained by the photoreceptor 1Y and the intermediate transfer belt 20 contacting each other with the toner image T interposed therebetween on the surface of the photoreceptor 1Y, which is a distance to a pressure contact portion (primary transfer position) by the transfer roll 5Y) may be determined in accordance with the rotation speed of the photoreceptor 1Y, an outer diameter of the photoreceptor, and the like. However, the distance is preferably equal to or greater than 5 mm, and more preferably in a range of from 5 mm to 10 mm.

In this exemplary embodiment, all of the first to fourth units 10Y, 10M, 10C, and 10K include guide units (guide rolls 9Y, 9M, 9C, and 9K). In a unit including such a guide unit, a developer containing the specific toner may preferably be applied as a developer stored in the developing device.

The units having such a configuration are provided and thus the filming on the intermediate transfer member (intermediate transfer belt 20) is prevented.

An example of an operation of forming a yellow image by the first unit 10Y will be described below.

First, before the operation, the surface of the photoreceptor 1Y is charged by the charging roller 2Y so as to have a potential from −600 V to −800 V.

The photoreceptor 1Y has properties in which resistance is normally high (resistance of a general resin), but the specific resistance of a portion irradiated with the laser beams changes when the laser beams 3Y are applied. Thus, the laser beams 3Y is output to the charged surface of the photoreceptor 1Y through the exposure device 3 in accordance with image data for yellow transmitted from the control unit (not illustrated). The photosensitive layer on the surface of the photoreceptor 1Y is irradiated with the laser beams 3Y, and thereby an electrostatic charge image of a yellow image pattern is formed on the surface of the photoreceptor 1Y.

The electrostatic charge image is an image which is formed on the surface of the photoreceptor 1Y by charging, and is a so-called negative latent image, which is formed by applying the laser beams 3Y to the photosensitive layer so that the specific resistance of the irradiated part is decreased to cause charges on the surface of the photoreceptor 1Y to flow while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at this developing position by the developing device 4Y.

The developing device 4Y stores, for example, a developer including at least a yellow toner and a carrier. The yellow toner is frictionally charged by performing stirring in the developing device 4Y and has charges with the same polarity (negative polarity) as the charge that is generated on the photoreceptor 1Y. Thus, the yellow toner is held on a developer roller. The surface of the photoreceptor 1Y is allowed to pass through the developing device 4Y, and thus the yellow toner electrostatically adheres to the electrostatic latent image on the surface of the photoreceptor 1Y, and thereby the electrostatic latent image is developed by using the yellow toner. The photoreceptor 1Y having the yellow toner image formed thereon is rotated at a predetermined rate and the toner image developed on the photoreceptor 1Y is transported to a predetermined primary transfer position (a pressure contact portion (a nip portion) by the transfer roll 5Y) while contacting with an intermediate transfer belt 20 deformed by a guide roll 9Y.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, and thereby the toner image on the photoreceptor 1Y is transferred onto the intermediate transfer belt 20. The transfer bias applied at this time has the opposite polarity (+) to the polarity (−) of the toner, and, for example, is controlled so as to be +10 μA in the first unit 10Y by the controller (not illustrated).

The residual substances remaining on the photoreceptor by are removed by the photoreceptor cleaning device 6Y, and a toner of the residual substances is collected.

The primary transfer biases which are applied to the primary transfer rollers 5M, 5C, and 5K of the second unit 10M and the subsequent units are also controlled similarly to a case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The four color toner images which have been multiply-transferred onto the intermediate transfer belt 20 through the first to fourth units reach a secondary transfer part that is made of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20.

A recording sheet (an example of the recording medium) P is fed to a gap between the secondary transfer roller 26 and the intermediate transfer belt 20, which contact with each other, through a supply mechanism at a predetermined timing, and a secondary transfer bias is applied to the support roller 24. The transfer bias applied at this time has the same polarity (−) as the polarity (−) of the toner. An electrostatic force toward the recording sheet P from the intermediate transfer belt 20 acts on the toner image, and thereby the toner image of four colors on the intermediate transfer belt 20 is transferred onto the recording sheet P. In this case, the secondary transfer bias is determined depending on the resistance detected by a resistance detector (not illustrated) that detects the resistance at the secondary transfer position, and is voltage-controlled. Then, the recording sheet P is transported to a nip portion between a pair of fixing rollers (an example of the fixing unit) 28 such that the toner image is fixed to the recording sheet P, and thereby a fixation image is formed.

The fixation temperature by the fixation unit is determined depending on the rotation speed of the photoreceptor (moving speed of the surface of the photoreceptor) and the kind of the toner. Normally, as the rotation speed of the photoreceptor becomes faster, the fixation temperature is preferably increased so as to sufficiently melt the toner. However, the specific toner used for forming a toner image in this exemplary embodiment has high meltability of a toner by containing the release agent therein from the vicinity of the surface layer portion of the toner to the inside of the toner. Accordingly, occurrence of fixation defect is difficult, for example, even when the fixation temperature is lowered. Since decreasing of the fixation temperature may results in reduction of the coarse particulates, the fixation temperature by the fixation unit is preferably 190° C. or less, more preferably 160° C. or more and 190° C. or less in this exemplary embodiment.

The moving speed of the surface of the image holding member is set in accordance with the kind of an image to be formed or the kind of a recording medium, and the like. However, from a viewpoint that image formation at a high speed is required, the moving speed is preferably equal to or higher than 300 mm/s, is more preferably equal to or higher than 500 mm/s, and is further preferably in a range of from 500 mm/s to 750 mm/s.

The recording sheet P on which the fixing of the color image is completed is discharged toward a discharge portion and a series of the color image forming operations is ended.

An example including a drum-shaped (cylindrical) photoreceptor and a belt-shaped intermediate transfer member is illustrated in FIGS. 1 and 2. However, this exemplary embodiment is not limited thereto.

For example, a belt-shaped photoreceptor and a drum-shaped intermediate transfer member may be combined. In addition, a belt-shaped photoreceptor and a belt-shaped intermediate transfer member may be combined.

In the former case, the guide unit may deform the belt-shaped photoreceptor to follow an outer circumference of the drum-shaped intermediate transfer member.

In the latter case, at least one of the belt-shaped photoreceptor and the belt-shaped intermediate transfer member may be deformed such that the deformed member causes an outer circumference of the belt-shaped photoreceptor and an outer circumference of the belt-shaped intermediate transfer member to follow each other.

The components (the photoreceptor, the charging unit, the electrostatic latent image forming unit, the developing unit, the primary and secondary transfer units, the intermediate transfer member, and the developer) constituting the image forming apparatus according to this exemplary embodiment will be more specifically described.

Descriptions will be made with omitting the reference numerals of the members.

Photoreceptor

As the photoreceptor in this exemplary embodiment, a well-known electrophotographic photoreceptor is applied.

The photoreceptor may have a drum shape (cylindrical shape) as illustrated in FIGS. 1 and 2, or have a belt shape, as described above.

The photoreceptor includes a photosensitive layer on an outer circumferential surface of a conductive substrate. The photoreceptor may include, besides the photosensitive layer, an undercoating layer which is provided between the conductive substrate and the photosensitive layer, an intermediated layer which is provided between the undercoating layer and the photosensitive layer, and a protection layer which is provided on the photosensitive layer, if necessary.

The photosensitive layer may be a function-separated (multi-layer) photosensitive layer which includes a charge generation layer having a charge generation function and a charge transport layer having a charge transport function. In addition, the photosensitive layer may be a function-integrated (single-layer) photosensitive layer which has the charge generation function and the charge transport function.

Charging Unit

In the image forming apparatus illustrated in FIG. 1, charging rollers 2Y, 2M, 2C, and 2K are used as the charging unit. However, it is not limited to this configuration.

As another example of the charging unit, usable is a contact charging member which uses a charging brush, a charging film, a charging rubber blade, a charging tube or the like.

A well-known charger such as a non-contact roller charger, and a scorotron charger or corotron charger using corona discharge may be used.

Electrostatic Latent Image Forming Unit

In the image forming apparatus illustrated in FIG. 1, the exposure device 3 capable of applying the laser beams 3Y, 3M, 3C, and 3K is used as the electrostatic latent image forming unit. However, it is not limited to this configuration.

A light source is used for forming an electrostatic latent image. The light source emits light such as a semiconductive laser beam, LED light, and light for a liquid crystal shutter. At this time, a wavelength of light emitted from the light source is in a spectral sensitivity area of the electrophotographic photoreceptor. Optical system equipment which enables formation of an electrostatic latent image according to an image data on the surface of the photoreceptor, and the like, are included.

Most of semiconductive laser beams are near-infrared area rays having an oscillation wavelength in the vicinity of 780 nm. However, it is not limited to this wavelength. As wavelength oscillation laser in a range of from 600 nm to less than 700 nm may be used or laser having an oscillation wavelength from 400 nm to 450 nm may be also used as blue laser. A surface-emitting laser light source which may output multi-beam is also effective for forming a color image.

Developing Unit

As the developing unit, for example, a general developing device which brings a developer into contact or non-contact with the photoreceptor so as to perform developing is included.

The developing device is not particularly limited as long as the developing device has the above-described function, and is selected depending on purposes. For example, a well-known developing device which has a function of causing a single-component developer or a two-component developer to adhere to the photoreceptor by using a brush, a roller and the like is included. Among the above-described devices, a developing device using a developing roller which holds a developer on a surface thereof is preferable.

A developer used in the developing unit (developing device) may be a single-component developer formed only of the specific toner which will be described later, and may be a two-component developer formed of the specific toner and a carrier. The developer may be magnetic or nonmagnetic.

Guide Unit

In the image forming apparatus illustrated in FIG. 1, the guide rolls 9Y, 9M, 9C, and 9K which are disposed on the inner side of the intermediate transfer belt 20 are used as the guide unit. However, it is not limited thereto.

The shape of the guide unit is not limited to a roll shape, and may be a plate shape, an arc shape, or the like.

As described above, the guide unit may deform at least one of the photoreceptor and the intermediate transfer member, and cause both of the members to follow each other before the primary transfer. Thus, a disposition position of the guide unit may be determined in accordance with the shapes of the photoreceptor and the intermediate transfer member. The disposition position of the guide unit is not limited to the inner side of the intermediate transfer member. The disposition position of the guide unit may be an inner side of the photoreceptor and be both of the inner side of the intermediate transfer member and the inner side of the photoreceptor.

The above-described guide unit is provided in order to prevent flying and scattering of the toner in the primary transfer. However, the image forming apparatus according to this exemplary embodiment may include a guide unit having a similar configuration for preventing flying and scattering of the toner in the secondary transfer.

Primary and Secondary Transfer Units

As the primary and secondary transfer units, intermediate transfer units using an intermediate transfer belt 20 are employed in the image forming apparatus illustrated in FIG. 1. As the transfer units, the primary transfer rolls 5Y, 5M, 5C, and 5K and the secondary transfer roll 26 are used, but the exemplary embodiment is not limited to this configuration.

As another example of the primary and secondary transfer units, a transfer unit using a direct transfer method, a transfer unit using a transfer belt method, and the like are included. In the direct transfer method, a transfer corotron, a transfer roll, or the like is used. In the transfer belt method, a recording medium is electrostatically adsorbed and transported and a toner image on the photoreceptor is transferred thereto.

For example, well-known transfer charging members such as a contact transfer charging member using a roller, a belt, a film, a rubber blade, and the like, a scorotron transfer charging member, and a corotron transfer charging member which use corona discharge are used as the primary and secondary transfer units.

Intermediate Transfer Member

In the image forming apparatus illustrated in FIG. 1, the intermediate transfer belt 20 is used as the intermediate transfer member. However, the exemplary embodiment is not limited thereto.

As another example of the shape of the intermediate transfer member, a drum shape is included.

In a case of the intermediate transfer belt, an intermediate transfer belt which has semiconductive properties and contains polyimide, polyamideimide, polycarbonate, polyarylate, polyester, rubber, or the like is used.

Developer Containing Specific Toner

A developer stored in the image forming apparatus according to this exemplary embodiment contains the specific toner which will be described below.

First, the specific toner will be described.

The specific toner contains a binder resin, a colorant, and a release agent, and has a sea and island structure in which a sea portion containing the binder resin and an island portion containing the release agent are provided.

In the sea and island structure, a maximum frequent value in distribution of the following eccentricity B of the island portion containing the release agent is in a range of from 0.75 to 0.95, a skewness in the distribution of the following eccentricity B is in a range of from −1.10 to −0.50, and the eccentricity B is represented by the following expression (1):

$$\text{Eccentricity } B = 2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

The configuration of the specific toner causes a portion of the release agent which exists close to the surface layer portion of the toner to prevent occurrence of photoreceptor filming as described above. The configuration of the specific toner causes the release agent which is contained from the vicinity of the surface layer portion of the toner to the inside of the toner to exhibit release properties in fixing.

In one toner of the related art, the release agent is positioned so as to be in the vicinity of a surface by using a difference in hydrophilic-hydrophobic properties between a binder resin and a release agent which are dissolved in a solvent. In the other toner of the related art, a release agent is positioned so as to be in the vicinity of a surface by using a kneading and pulverizing method with an uneven distribution-controlling resin, and the uneven distribution-controlling resin has both of a portion with a porality similar to a polarity of a binder resin and a portion with a porality similar to a polarity of the release agent. However, the above toners control a position of a release agent in a toner by using a physical property of a material and do not cause distribution of the release agent domain of a toner to have a gradient.

The specific toner will be described below in detail.

The specific toner has the sea and island structure in which the sea portion containing a binder resin and the island portion containing a release agent are present. That is, the specific toner has the sea and island structure in which the release agent exists in a continuous phase of the binder resin so as to have an island shape.

In the toner having the sea and island structure, the maximum frequent value in distribution of eccentricity B of the release agent domain (island portion containing the release agent) is in a range of from 0.75 to 0.95, is preferably in a range of from 0.80 to 0.95, more preferably in a range of from 0.80 to 0.90, and most preferably in a range of from 0.85 to 0.90.

The maximum frequent value being 0.75 or more causes the release agent domain to be close to the surface layer portion of the toner and thus the occurrence of the filming on the intermediate transfer member may be prevented. The maximum frequent value being 0.95 or less prevents the release agent domain from exposing to the surface of the toner, and bleeding of the release agent will not occur without applying pressure. Thus, the release agent may be used efficiently for the prevention of the occurrence of the filming on the intermediate transfer member.

Skewness in the distribution of the eccentricity B of the release agent domain (island portion containing the release agent) is in a range of from −1.10 to −0.50, preferably in a range of from −1.00 to −0.60, and more preferably in a range of from −0.95 to −0.65.

The skewness being in the range of from −1.10 to −0.50 prevents the occurrence of the filming on the intermediate transfer member and causes the release properties to exhibit in fixing.

Kurtosis in the distribution of the eccentricity B of the release agent domain (island portion containing the release agent) is preferably in a range of from −0.20 to +1.50, more preferably in a range of from −0.15 to +1.40, further preferably in a range of from −0.10 to +1.40, and most preferably in a range of from −0.10 to +1.30 from a viewpoint of appearance of the release properties in fixing and prevention of the occurrence of the filming on the intermediate transfer member.

The kurtosis is an index indicating a sharp point of a vertex (that is, the maximum frequent value in the distribution) in the distribution of the eccentricity B. The kurtosis being in the above range indicates a state where an apex portion (maximum frequent value) is not excessively sharp, the apex portion is sharp but simultaneously is appropriately curved in the distribution of the eccentricity B is made. For this reason, the amount of bleeding of the release agent from the toner is smoothly changed depending on pressure and thus, balance of appearance of the release properties in fixing and prevention of the occurrence of the filming on the intermediate transfer member becomes better.

A confirming method of the sea and island structure of the toner will be described.

The sea and island structure of the toner is confirmed, for example, by a method of observing a cross-section of the toner (toner particle) using a transmission electron microscope, or a method of dyeing a cross-section of the toner particle with ruthenium tetroxide and observing the dyed cross-section using a scanning electron microscope. The method of observation using a scanning electron microscope is preferable in that the release agent domain in the cross-section of the toner may be observed more clearly. As the scanning electron microscope, a model which has been known well to those skilled in the related art may be used. For example, SU8020 manufactured by Hitachi High-Technologies Corporation, JSM-7500F manufactured by JEOL Ltd., and the like are included.

Specifically, an observing method is performed as follows. First, a toner (toner particle) to be measured is embedded in an epoxy resin, and then the epoxy resin is cured. This cured substance is cut into a thin section with a microtome including a diamond blade to thereby obtain an observation sample in which a cross-section of the toner is exposed. Dyeing with ruthenium tetroxide is performed on the thin observation sample and the cross-section of the toner is observed by using a scanning electron microscope. Using this observing method, a sea and island structure in which a release agent having a brightness difference (contrast) caused by a dyeing degree with respect to a continuous phase of a binder resin exists so as to have an island shape in the cross-section of the toner is observed.

Next, a measuring method of the eccentricity B of the release agent domain will be described.

The eccentricity B of the release agent domain is measured as follows. First, an image is recorded at magnification which allows a cross-section of one toner (toner particle) to come in sight, by using the confirming method of the sea and island structure. Image analysis for the recorded image is performed under a condition of 0.010000 μm/pixel by using image analysis software (WINROOF manufactured by MITANI Corporation). A shape of the cross-section of the toner is extracted by this image analysis by using a brightness difference (contrast) between the epoxy resin used in embedding and the binder resin of the toner. A projected area is obtained based on the extracted shape of the cross-section of the toner. An equivalent circle diameter is obtained from the projected area. The equivalent circle diameter is calculated by an expression of $2\sqrt{(\text{projected area}/\pi)}$. The obtained equivalent circle diameter is set as an equivalent circle diameter D of the toner in observation of the cross-section of the toner.

A centroid position is obtained based on the extracted shape of the cross-section of the toner. Subsequently, a shape of the release agent domain is extracted by using a brightness difference (contrast) between the binder resin and the release agent, and a centroid position of the release agent domain is obtained. Each of the centroid positions is obtained as follows. x coordinates of the centroids are values obtained by dividing summation of $x_i$ coordinate values by n, and y coordinates of the centroids are values obtained by dividing summation of $y_i$ coordinate values by n, when the number of pixels in an area of the extracted toner or the extracted release agent domain is set as n, xy coordinates of each pixel are set as $x_i$ and $y_i$ (i=1, 2, . . . , n). A distance between the centroid position of the cross-section of the toner and the centroid position of the release agent domain is obtained. The obtained distance is set as a distance d from the centroid of the toner to the centroid of the island portion containing the release agent in observation of the cross-section of the toner.

At last, the eccentricity B of the release agent domain is obtained based on each of the equivalent circle diameter D and the distance d by using Expression (1) (eccentricity B=2d/D). Similarly, the above-described operation is performed on each of plural release agent domains in the cross-section of one toner (toner particle) and thereby the eccentricity B of the release agent domain is obtained.

Next, a calculating method of the maximum frequent value in distribution of the eccentricity B of the release agent domain will be described.

First, the eccentricity B of the release agent domain for 200 toners (toner particles) is measured as described above. Data of the obtained eccentricity B of each of the release agent domains is subjected to statistical analysis processing in a data sections from 0 in increment of 0.01, and thereby the distribution of the eccentricity B is obtained. The maximum frequent value in the obtained distribution, that is, a value of a data section which appears most in the distribution of the eccentricity B of the release agent domain is obtained. The value of this data section is set as the maximum frequent value in the distribution of the eccentricity B of the release agent domain.

Next, a calculating method of the skewness in the distribution of the eccentricity B of the release agent domain will be described.

First, the distribution of the eccentricity B of the release agent domain is obtained as described above. The skewness in the distribution of the eccentricity B is obtained based on the following expression. In the following expression, the skewness is set as Sk, the number of pieces of data of the eccentricity B of the release agent domain is set as n, values of data of the eccentricity B of the respective release agent domains are set as $x_i$ (i=1, 2, . . . , n), an average value of all pieces of data of the eccentricity B of the release agent domain is set as x (x with a bar above), and a standard deviation of all pieces of data of the eccentricity B of the release agent domain is set as s.

$$Sk = \frac{n}{(n-1)(n-2)} \sum_{i=1}^{n} \left( \frac{x_i - \bar{x}}{s} \right)^3$$

Next, a calculating method of the kurtosis in the distribution of the eccentricity B of the release agent domain will be described.

First, the distribution of the eccentricity B of the release agent domain is obtained as described above. The kurtosis in the obtained distribution of the eccentricity B is obtained based on the following expression. In the following expression, the kurtosis is set as Ku, the number of pieces of data of the eccentricity B of the release agent domain is set as n, values of data of the eccentricity B of the respective release agent domains are set as $x_i$ (i=1, 2, . . . , n), an average value of all pieces of data of the eccentricity B of the release agent domain is set as x (x with a bar above), and a standard deviation of all pieces of data of the eccentricity B of the release agent domain is set as s.

$$Ku = \frac{n(n+1)}{(n-1)(n-2)(n-3)} \sum_{i=1}^{n} \left( \frac{x_i - \bar{x}}{s} \right)^4 - \frac{3(n-1)^2}{(n-2)(n-3)}$$

Regarding a method for satisfying distribution characteristics of the eccentricity B of the release agent domain in a toner, it will be described in a method of preparing the toner.

Components of the specific toner will be described below.

The specific toner contains a binder resin, a colorant, and a release agent. Specifically, the toner contains toner particles including the binder resin, the colorant, and the release agent. The toner may contain an external additive adhering to a surface of the toner particle.

Binder Resin

Examples of the binder resin include vinyl resins formed of homopolymers of monomers such as styrenes (for example, styrene, parachlorostyrene, and α-methylstyrene), (meth) acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more kinds thereof.

As the binder resin, a polyester resin is appropriate.

As the polyester resin, for example, a well-known polyester resin is included.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The polyester resin is obtained by a known preparing method. Specific examples thereof include a method of performing a reaction at a polymerization temperature set to be in a range of from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is performed while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably in a range of from 40% by weight to 95% by weight, more preferably in a range of from 50% by weight to 90% by weight, and further preferably in a range of from 60% by weight to 85% by weight relative to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may be used singly or in combination of two or more types thereof.

If necessary, the colorant may be surface-treated or used in combination with a dispersing agent. Plural types of colorants may be used in combination.

The content of the colorant is, for example, preferably in a range of from 1% by weight to 30% by weight, and more preferably in a range of from 3% by weight to 15% by weight relative to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters; and the like. The release agent is not limited to these examples.

Among these substances, as the release agent, the hydrocarbon wax (waxes having hydrocarbon as a skeleton) is preferable. The hydrocarbon wax is appropriate because the release agent domain is easily formed and rapid bleeding to the surface of the toner (toner particle) easily occurs in fixing.

The content of the release agent is, for example, preferably in a range of from 1% by weight to 20% by weight, and more preferably in a range of from 5% by weight to 15% by weight relative to the entire toner particles.

Other Additives

Examples of other additives include known additives such as a magnetic material, a charge controlling agent, and inorganic powder. The toner particles contain these additives as internal additives.

Characteristics of Toner Particles

The toner particles may be toner particles having a single-layer structure, or be toner particles having a so-called core/shell structure composed of a core (core particle) and a coating layer (shell layer) coated on the core.

Here, toner particles having a core/shell structure is preferably composed of, for example, a core containing a binder resin, and other additives such as a colorant and a release agent and a coating layer containing a binder resin.

The volume average particle diameter (D50v) of the toner particles is preferably in a range of from 2 μm to 10 μm, and more preferably in a range of from 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$\text{Expression: } SF1=(ML^2/A)\times(\pi/4)\times 100$$

In the foregoing expression, ML represents an absolute maximum length of a toner, and A represents a projected area of a toner.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment with a hydrophobizing agent. The treatment with a hydrophobizing agent is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin particles) and a cleaning aid (for example, metal salt of higher fatty acid represented by zinc stearate, and fluorine polymer particles).

The amount of the external additive externally added is, for example, preferably in a range of from 0.01% by weight to 5% by weight, and more preferably in a range of from 0.01% by weight to 2.0% by weight relative to the toner particles.

Method of Preparing Specific Toner

Next, a method of preparing the specific toner will be described.

The specific toner is obtained by externally adding an external additive to toner particles after preparing the toner particles.

The toner particles may be prepared using any of a dry preparing method (for example, kneading and pulverizing method) and a wet preparing method (for example, aggregation and coalescence method, suspension and polymerization method, and dissolution and suspension method). The toner particle preparing method is not particularly limited to these preparing methods, and a known preparing method is employed.

Among these methods, the toner particles may preferably be obtained by the aggregation and coalescence method.

For preparing the toner (toner particle) which satisfies the above-described distribution characteristics of the eccentricity B of the release agent domain as described above, the toner particle may preferably be prepared by an aggregation and coalescence method described below.

Specifically, the toner particle is preferably prepared by processes as follows: a process of preparing each dispersion (dispersion preparation process); a process (first aggregated particle forming process); a process (second aggregated particle forming process); and a process (coalescence process). In the first aggregated particle forming process, particles are aggregated in a dispersion obtained by mixing a first resin particle dispersion and a colorant particle dispersion, and thereby first aggregated particles are formed. The first resin particle dispersion is obtained by dispersing first resin particles corresponding to the binder resin, and the colorant particle dispersion is obtained by dispersing particles of the colorant (also referred to as "colorant particles" below). In the second aggregated particle forming process, a dispersion mixture in which second resin particles corresponding to the binder resin and particles of the release agent (also referred to as "release agent particles" below) are dispersed is prepared. After a first aggregated particle dispersion in which the first aggregated particles are dispersed is prepared, the dispersion mixture is sequentially added to the first aggregated particle dispersion while the concentration of the release agent particles in the dispersion mixture gradually increases. Thus, the second resin particles and the release agent particles are aggregated on a surface of the first aggregated particles, and thereby second aggregated particles are formed. In the coalescence process, a second aggregated particle dispersion in which the second aggregated particles are dispersed is heated to coalesce the second aggregated particles, and thereby toner particles are formed.

The method of preparing the toner particle is not limited to the above descriptions. For example, particles are aggregated in a dispersion mixture obtained by mixing the resin particle dispersion and the colorant particle dispersion. Then, a release agent particle dispersion is added to the dispersion mixture in the process of aggregation while increasing an addition speed gradually or while increasing the concentration of the release agent particles increases. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a colorant particle dispersion in which colorant particles are dispersed, a second resin particle dispersion in which second resin particles corresponding to the binder resin are dispersed, and a release agent particle dispersion in which release agent particles are dispersed are prepared.

In the dispersion preparation process, descriptions will be made, referring the first resin particles and the second resin particles to as "resin particles" collectively.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Process

Next, the first resin particle dispersion and the colorant particle dispersion are mixed together.

The first resin particles and the colorant particles are heterogeneously aggregated in the dispersion mixture, and thereby first aggregated particles including first resin particles and colorant particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the release agent particles are dispersed is sequentially added to the first aggregated particle dispersion while increasing the concentration of the release agent particles in the dispersion mixture gradually.

The second resin particles may be the same type as or a different type or from the first resin particles.

The second resin particles and the release agent particles are aggregated on surfaces of the first aggregated particles in a dispersion in which the first aggregated particles, the second resin particles, and the release agent particles are dispersed. Specifically, for example, in the first aggregated particle forming process, when a particle diameter of the first aggregated particle reaches a desired particle diameter, a dispersion mixture in which the second resin particles and the release agent particles are dispersed is added to the first aggregated particle dispersion while increasing the concentration of the release agent particles gradually. The dispersion is heated at a temperature which is equal to or less than the glass transition temperature of the second resin particles.

For example, the pH of the dispersion is substantially in a range of from 6.5 to 8.5, and thus the progress of the aggregation is stopped.

Aggregated particles in which the second resin particles and the release agent particles are attached to the surfaces of the first aggregated particles are formed through this process. That is, second aggregated particles in which aggregates of the second resin particles and the release agent particles are attached to the surfaces of the first aggregated particles are formed. At this time, since the dispersion mixture in which the second resin particles and the release agent particles are dispersed is sequentially added to the first aggregated particle dispersion while increasing the concentration of the release agent particles in the dispersion mixture gradually, the concentration (abundance ratio) of the release agent particles becomes gradually larger toward the radially outside direction of the particles, and the aggregates of the second resin particles and the release agent particles are attached to the surface of the first aggregated particle.

As a method of adding the dispersion mixture, a power feeding addition method may preferably be used. The dispersion mixture may be added to the first aggregated particle dispersion, with a gradual increase of the concentration of the release agent particles in the dispersion mixture, by using the power feeding addition method.

The method of adding the dispersion mixture using the power feeding addition method will be described with reference to the drawing.

Figure 3:
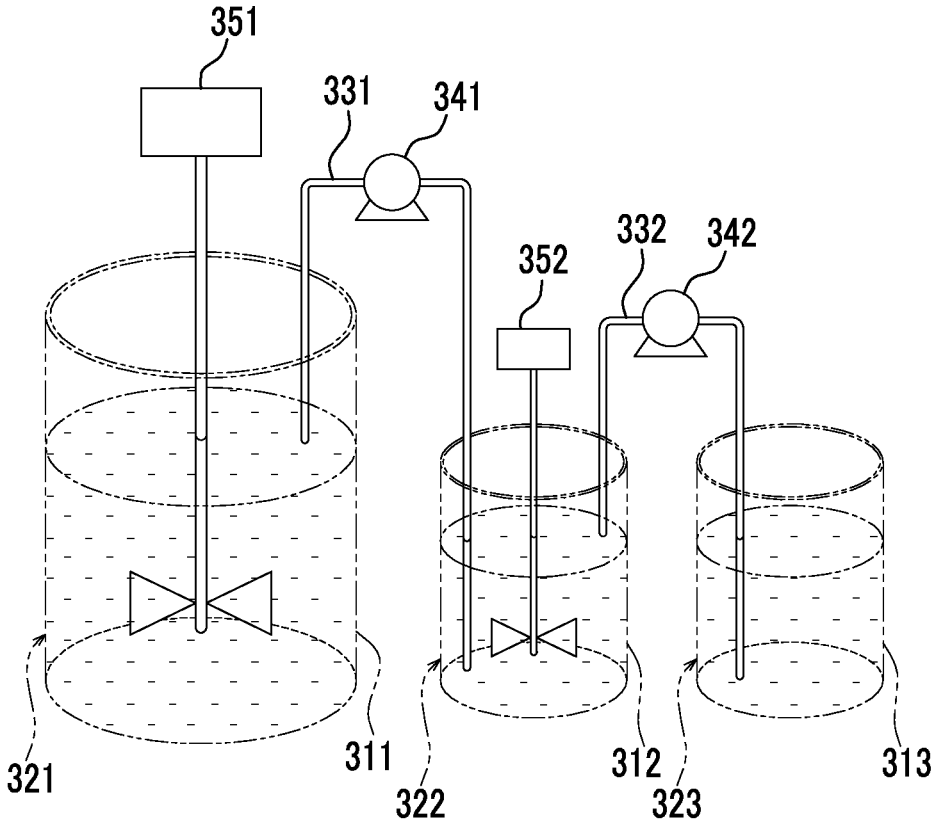
FIG. 3 is a schematic diagram illustrating a power feeding addition method.

FIG. 3 illustrates an apparatus used in the power feeding addition method. In FIG. 3, the reference numeral 311 indicates the first aggregated particle dispersion, the reference numeral 312 indicates the second resin particle dispersion, the reference numeral 313 indicates the release agent particle dispersion.

The apparatus illustrated in FIG. 3 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the release agent particle dispersion in which the release agent particles are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 3, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The release agent particle dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the release agent particle dispersion is sequentially transported to the second resin particle dispersion stored in the second storage tank 322, and thus the concentration of the release agent particles becomes higher gradually. For this reason, the dispersion mixture in which second resin particles and the release agent particles are dispersed is stored in the second storage tank 322, and this dispersion mixture is transported to the first aggregated particle dispersion stored in the first storage tank 321. The dispersion mixture is continuously transported with an increase of the concentration of the release agent particle dispersion in the dispersion mixture.

In this manner, the dispersion mixture in which the second resin particles and the release agent particles are dispersed may be added to the first aggregated particle dispersion with a gradual increase of the concentration of the release agent particles, by using the power feeding addition method.

In the power feeding addition method, the distribution characteristics of the release agent domain of the toner are adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, the distribution characteristics of the release agent domain of the toner are adjusted.

Specifically, for example, the maximum frequent value in the distribution of the eccentricity B of the release agent domain is adjusted depending on a period of time when transporting of the release agent particle dispersion to the second storage tank 322 from the third storage tank 323 is ended. More specifically, for example, if transporting of the release agent particle dispersion to the second storage tank 322 from the third storage tank 323 is ended before liquid transporting to the first storage tank 321 from the second storage tank 322 is ended, the concentration of the release agent particles in the dispersion mixture of the second storage tank 322 does not increase from that point of time. Thus, the maximum frequent value in the distribution of the eccentricity B of the release agent domain becomes smaller.

For example, the skewness in the distribution of the eccentricity B of the release agent domain is adjusted depending on a period of time when the dispersions are respectively transported from the second storage tank 322 and the third storage tank 323, and a liquid transport speed at which the dispersion is transported to the first storage tank 321 from the second storage tank 322. More specifically, for example, if a liquid transport starting time of the release agent particle dispersion from the third storage tank 323 and a liquid transport starting time of the dispersion from the second storage tank 322 are early, and the liquid transport speed of the dispersion from the second storage tank 322 is lowered, a state where the release agent particles are disposed from a further inner side of the formed aggregated particle to a further outer side thereof is realized. Thus, the skewness in the distribution of the eccentricity B of the release agent domain becomes greater.

For example, the kurtosis in the distribution of the eccentricity B of the release agent domain is adjusted by changing the liquid transport speed of the release agent particle dispersion from the third storage tank 323 in the process of liquid transport. More specifically, for example, if only the liquid transport speed of the release agent particle dispersion from the third storage tank 323 becomes faster in the process of liquid transport, the concentration of the release agent particles in the dispersion of the second storage tank 322 becomes higher from that time. For this reason, there arises a state where many of the release agent particles are disposed in a certain area (certain deep portion) in a radial direction of the aggregated particle in the formed aggregated particle. Thus, the kurtosis in the distribution of the eccentricity B of the release agent domain becomes greater.

The above-described power feeding addition method is not limited to the above method. For example, various methods may be employed. Examples of the various methods include a method in which, a storage tank storing the second resin particle dispersion and a storage tank storing a dispersion mixture in which the second resin particles and the release agent particles are dispersed are separately provided and the respective dispersions are transported to the first storage tank 321 from the respective storage tanks while changing the liquid transport speed, a method in which a storage tank storing the release agent particle dispersion and a storage tank storing a dispersion mixture in which the second resin particles and the release agent particles are dispersed are separately provided, and the respective dispersions are transported to the first storage tank 321 from the respective storage tanks while changing the liquid transport speed, and the like.

As described above, the second aggregated particles in which the second resin particles and the release agent particles are attached to the surfaces of the first aggregated particles and aggregated are obtained.

Coalescence Process

Next, the second aggregated particle dispersion in which the second aggregated particles are dispersed is heated at, for example, a temperature that is equal to or higher than the glass transition temperature of the first and second resin particles (for example, a temperature that is higher than the glass transition temperature of the first and second resin particles by 10° C. to 30° C.) to coalesce the second aggregated particles and form toner particles.

The toner particles are obtained through the above-described processes, but the following method is preferable in order to cause the maximum frequent value in the distribution of the eccentricity B of the release agent domain to be equal to or less than 0.95.

That is, after the aggregated particle dispersion in which the second aggregated particles are dispersed is obtained, toner particles may be prepared through the processes of:

further mixing the second aggregated particle dispersion with a third resin particle dispersion in which third resin particles corresponding to the binder resin are dispersed to perform aggregation so that the third resin particles further adhere to the surfaces of the second aggregated particles, thereby forming third aggregated particles; and coalescing the third aggregated particles by heating the third aggregated particle dispersion in which the third aggregated particles are dispersed, and thereby forming toner particles having a core/shell structure.

A coating layer formed by only the third resin particles is formed by this operation, and the maximum frequent value in the distribution of the eccentricity B of the release agent domain is equal to or less than 0.95.

The third aggregated particle may be the same type as or different type from the first resin particles and the second resin particles.

After the coalescence process is ended, toner particles formed in a solution are subjected to a well-known washing process, a well-known solid-liquid separation process, a well-known drying process, and thereby dried toner particles are obtained.

Regarding the washing process, replacing washing using ion exchanged water may preferably be sufficiently performed for charging property. The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The specific toner is prepared, for example, by adding an external additive to the obtained toner particles in a dried state, and performing mixing. The mixing may be performed, for example, by using a V blender, a HENSCHEL mixer, a LÖdige mixer, or the like. Furthermore, if necessary, coarse toner particles may be removed using a vibration sieving machine, a wind classifier, or the like.

Developer

The developer contains at least the above-described specific toner.

The developer may be a single-component developer which contains only the specific toner, or be a two-component developer obtained by mixing the specific toner with a carrier.

The carrier is not particularly limited, and known carriers may be used. Examples of the carrier include a coated carrier in which surface of core formed of a magnetic powder is coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores which are coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metal such as gold, silver, and copper, and particles of carbon black, titanium oxide, zinc oxide, tin oxide, barium sulfate, aluminum borate, potassium titanate, and the like.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the specific toner and the carrier in the two-component developer is preferably from 1:100 to 30:100, and more preferably from 3:100 to 20:100 (toner:carrier).

An example of the image forming apparatus according to this exemplary embodiment is described with reference to the drawings. However, the exemplary embodiment is not limited to the descriptions.

EXAMPLES

This exemplary embodiment will be described more specifically in detail by using examples and comparative examples. However, this exemplary embodiment is not limited these examples. A "part" means a "part by weight" unless otherwise indicated.

Preparation of Resin Particle Dispersion

Preparation of Resin Particle Dispersion (1)

30 parts by mol of terephthalic acid, 70 parts by mol of fumaric acid, 5 parts by mol of an ethylene oxide adduct of bisphenol A, and 95 parts by mol of a propylene oxide adduct of bisphenol A are put into a 5-liter flask provided with a stirrer, a nitrogen inlet tube, a thermometer, and a rectifying column. The temperature of the flask is increased up to 210° C. over one hour, and 1 part of titanium tetraethoxide relative to 100 parts of the materials is put into the flask. The temperature is increased up to 230° C. over 0.5 hours while generated water is distilled away. After a dehydration condensation reaction is continued at that temperature for one hour, the reactant is cooled. In this manner, Polyester resin (1) having a weight-average molecular weight of 18,500, an acid value of 14 mgKOH/g, and a glass transition temperature of 59° C. is synthesized.

40 parts of ethyl acetate and 25 parts of 2-butanol are put into a container provided with a temperature adjusting unit and a nitrogen substituting unit to obtain mixed solvent. Then, 100 parts of Polyester resin (1) are slowly put into the mixed solvent to thereby be dissolved. 10% by weight of an ammonia aqueous solution (having an amount corresponding to three times an acid value of the resin in a molar ratio) is put into the obtained mixture, followed by stirring for 30 minutes.

Then, substitution with dry nitrogen is performed in the container, and the temperature is held at 40° C. 400 parts of ion-exchanged water are dropped into the liquid mixture at a speed of 2 parts/minute while stirring to prepare an emulsion. After dropping is ended, the temperature of the emulsion is returned to the room temperature (20° C. to 25° C.), and bubbling is performed for 48 hours by using dry nitrogen while stirring such that ethyl acetate and 2-butanol are reduced to be equal to or less than 1,000 ppm. Thus, a resin particle dispersion in which resin particles having a volume average particle diameter of 200 nm are dispersed is obtained. Ion-exchanged water is added to the resin particle dispersion so as to adjust a solid content to be 20% by weight, and the obtained dispersion is used as Resin particle dispersion (1).

Preparation of Colorant Particle Dispersion

Preparation of Colorant Particle Dispersion (1)

70 parts of a cyan pigment: C.I. Pigment Blue 15:3 (copper phthalocyanine, product manufactured by DIC Corporation, product name: FASTOGEN BLUE LA5380), 5 parts of anionic surfactant (NEOGEN RK, product manufactured by DKS Co., Ltd.), and 200 parts of ion-exchanged water are mixed with each other, and are dispersed by using a homogenizer (ULTRA-TURRAX T50, product manufactured by IKA Corporation) for 10 minutes. Ion-exchanged water is added so as to cause a solid content in the dispersion to be 20% by weight, and thereby Colorant particle dispersion (1) in which colorant particles having a volume average particle diameter of 190 nm are dispersed is obtained.

Preparation of Release Agent Particle Dispersion

Preparation of Release Agent Particle Dispersion (1)

100 parts of a paraffin wax (HNP-9, product manufactured by NIPPON SEIRO Co., Ltd.), 1 part of an anionic surfactant (NEOGEN RK, product manufactured by DKS Co., Ltd.), 350 parts of ion-exchanged water are mixed with each other, heated up to 100°, and dispersed by using a homogenizer (ULTRA-TURRAX T50, product manufactured by IKA Corporation). Then, dispersing is performed by using a Manton-Gaulin high-pressure homogenizer (product manufactured by Gaulin Corporation), to thereby obtain Release agent particle dispersion (1) (solid content of 20% by weight) in which release agent particles having a volume average particle diameter of 200 nm are dispersed.

Preparation of Developer (1) Containing Specific Toner

Preparation of Toner Particle (1)

An apparatus (see FIG. 4) having the following configuration is prepared: a round stainless steel flask and a container A are connected to each other by using a tube pump A; driving of the tube pump A causes a liquid stored in the container A is transported to the flask; the container A and a container B are connected to each other by using a tube pump B; driving of the tube pump B causes a liquid stored in the container B to be transported to the container A. The following operations are performed by using this apparatus.

500 parts of Resin particle dispersion (1), 40 parts of Colorant particle dispersion (1), and 2 parts of an anionic surfactant (TAYCAPOWER) are put into a round stainless steel flask, and 0.1 N nitric acid is added to the liquid so as to adjust the pH of the liquid to 3.5. Then, 30 parts of a nitric acid aqueous solution in which a concentration of polyaluminum chloride is 10% by weight are added thereto. Subsequently, the obtained mixture is dispersed at 30° C. by using a homogenizer (ULTRA-TURRAX T50, product manufactured by IKA Corporation), and then, the temperature of the obtained dispersion is increased at a pace of 1° C./30 minutes in an oil bath for heating to thereby increase a particle diameter of aggregated particles.

150 parts of Resin particle dispersion (1) are put into the container A which is a bottle made of a polyester, and 25 parts of Release agent particle dispersion (1) are put into the container B which is a bottle made of a polyester. Then, a liquid transport speed of the tube pump A is set to 0.70 parts/1 minute, and a liquid transport speed of the tube pump B is set to 0.14 parts/1 minute. The tube pumps A and B are driven from a point of time when the temperature of the inside of the round stainless steel flask in the process of forming of the aggregated particle reaches 37.0° C., and thus transporting of the respective dispersions is started. Accordingly, a dispersion mixture in which resin particles and release agent particles are dispersed is transported from the container A to the round stainless steel flask which is in the process of forming of the aggregated particle, with a gradual increase of the concentration of the release agent particles.

The content of the flask is held for 30 minutes from a point of time when the temperature of the inside of the flask is 48° C. after transporting of the dispersions to the flask is ended, and thereby second aggregated particles are formed.

Then, 50 parts of Resin particle dispersion (1) are added slowly and the obtained mixture is held for 1 hour. 0.1 N sodium hydroxide aqueous solution is added thereto to thereby adjust the pH of the mixture to 8.5. Then, heating is performed up to 85° C. with continuous stirring, and the resultant is held for 5 hours. Then, the resultant is cooled to 20° C. at a speed of 20° C./minute, is filtered, is sufficiently washed by using ion-exchanged water, and then is dried. Thus, Toner particles (1) having a volume average particle diameter of 6.0 μm are obtained.

Preparation of Specific Toner (1)

100 parts of Toner particle (1), 0.7 parts of dimethyl silicone oil-treated silica particles (RY200, product manufactured by NIPPON AEROSIL CO., LTD.) are mixed with each other by using a HENSCHEL mixer (peripheral speed of 30 m/s, 3 minutes), and thereby Specific toner (1) is obtained.

Evaluation of Filming on Intermediate Transfer Member

The image forming apparatus is kept at 40° C. for one month.

After being kept, double-sided printing of an image with an image density of 15% is continuously performed on 100,000 pieces of paper having A4 size under an environment of a temperature of 28° C. and 85% RH.

After the double-sided printing is continuously performed on 100,000 pieces of paper, the surface of the intermediate transfer belt is observed with eyes, and it is confirmed whether or not filming occurs. The results are shown in Table 1.

TABLE 1

| | Toner No. | Distribution of eccentricity B of release agent domain: Maximum frequent value | Skewness | Kurtosis | Rotation speed of photoreceptor (mm/s) | Evaluation Filming on intermediate transfer member |
|---|---|---|---|---|---|---|
| Example 1 | (1) | 0.88 | −0.80 | 0.60 | 600 | no occurrence |
| Comparative Example 1 | (C1) | 0.74 | −1.08 | 0.53 | 600 | occurrence |

Preparation of Developer (1)

Among 100 parts of ferrite particles (average particle diameter of 50 μm), 14 parts of toluene, 3 parts of a styrene/methyl methacrylate copolymer (copolymerization ratio: 15/85), and 0.2 parts of carbon black, the components except for the ferrite particles are dispersed in a sand mill to thereby prepare a dispersion. This dispersion and the ferrite particles are put into a vacuum degassing kneader. Decompression and drying is performed with stirring to thereby obtain a carrier.

8 parts of Specific toner (1) are mixed with 100 parts of the carrier, and thereby Developer (1) is obtained.

Preparation of Developer (C1) Containing Comparative Toner

Toner particles (C1) are obtained in the same manner as in preparing of Toner particles (1) except that the liquid transport speed of the tube pump A is set to 0.55 parts/1 minute, the liquid transport speed of the tube pump B is set to 0.11 parts/1 minute and the tube pumps A and B are driven from a point of time when the temperature of the inside of the flask reaches 30.0° C. Toner particles (C1) have a volume average particle diameter of 5.2 μm.

Similarly to preparation of Specific toner (1), Comparative toner (C1) is prepared by using Toner particles (C1). Similarly to preparation of Developer (1), Developer (C1) is obtained by using Comparative toner (C1).

Various Measurements

Regarding the toner of the developer obtained in each of the examples, the maximum frequent value, the skewness, and the kurtosis in the distribution of the eccentricity B of the release agent domain are measured by using the above-described methods. The results are shown in Table 1.

Evaluation

A modified machine in which a D136 Printer (manufactured by Fuji Xerox Co., Ltd.) is provided with a guide roll for performing a guide by deforming an intermediate transfer belt so as to follow the photoreceptor is prepared, and the above-described developer is stored in the developing device.

The rotation speed of the surface of the photoreceptor when an image is formed is set to 600 mm/s, and the fixation temperature by the fixing unit is set to 175° C.

The distance obtained by the guide roll causing the portion of the surface of the electrophotographic photoreceptor and the portion of the surface of the intermediate transfer member to follow each other is set to 10 mm.

It is confirmed based on the result that this example is different from the comparative example in that the filming on the intermediate transfer member does not form.

Here, since a content of the release agent in the specific toner is equal to that in the comparison toner, it is confirmed that the occurrence of the filming on the intermediate transfer member is prevented without an increase of the content of the release agent in the toner, in the image forming apparatus of this example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on a charged surface of the image holding member;

a developing unit that stores a developer containing a toner and develops the electrostatic charge image formed on the surface of the image holding member so as to form a toner image;

an intermediate transfer member onto a surface of which the toner image is transferred;

a primary transfer unit that primarily transfers the toner image formed on the surface of the image holding member onto the surface of the intermediate transfer member;

a secondary transfer unit that secondarily transfers the toner image transferred onto the surface of the intermediate transfer member onto a surface of a recording medium; and a guide unit that is provided on an upstream side of the primary transfer unit in a rotation direction of the intermediate transfer member, and guides at least one of the image holding member and the intermediate transfer member to a primary transfer position by the primary transfer unit so as to cause a portion of the surface of the image holding member and a portion of the surface of the intermediate transfer member to follow each other, wherein the toner contains a binder resin, a colorant, and a release agent and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

2. The image forming apparatus according to claim 1, wherein a moving speed of the surface of the image holding member is equal to or higher than 300 mm/s.

3. The image forming apparatus according to claim 1, wherein a distance obtained by the guide unit causing the portion of the surface of the image holding member and the portion of the surface of the intermediate transfer member to follow each other is in a range of from 5 mm to 10 mm.

4. The image forming apparatus according to claim 1, wherein a kurtosis of the distribution of the eccentricity B in the toner is in a range of from −0.20 to +1.50.

5. The image forming apparatus according to claim 1, wherein the maximum frequent value in the distribution of the eccentricity B in the toner is in a range of from 0.80 to 0.90.

6. The image forming apparatus according to claim 1, wherein a kurtosis of the distribution of the eccentricity B in the toner is in a range of from −0.10 to +1.40.

7. An image forming method comprising:

charging a surface of an image holding member;

forming an electrostatic latent image on the charged surface of the image holding member;

developing the electrostatic latent image formed on the surface of the image holding member by using a developer containing a toner so as to form a toner image;

primarily transferring the toner image formed on the surface of the image holding member onto a surface of an intermediate transfer member;

secondarily transferring the toner image transferred onto the surface of the intermediate transfer member onto a surface of a recording medium; and performing a guide to a primary transfer position in the primarily transferring before the primarily transferring, by causing a portion of the surface of the image holding member on which the toner image is formed and a portion of the surface of the intermediate transfer member to follow each other with the toner image interposed between the image holding member and the intermediate transfer member, wherein the toner contains a binder resin, a colorant, and a release agent and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

8. The image forming method according to claim 7, wherein a moving speed of the surface of the image holding member is equal to or higher than 300 mm/s.

9. The image forming method according to claim 7, wherein, in performing the guide, a distance obtained by causing the portion of the surface of the image holding member and the portion of the surface of the intermediate transfer member to follow each other is in a range of from 5 mm to 10 mm.

10. The image forming method according to claim 7, wherein a kurtosis of the distribution of the eccentricity B in the toner is in a range of from −0.20 to +1.50.

11. The image forming method according to claim 7, wherein the maximum frequent value in the distribution of the eccentricity B in the toner is in a range of from 0.80 to 0.90.

12. The image forming method according to claim 7, wherein a kurtosis of the distribution of the eccentricity B in the toner is in a range of from −0.10 to +1.40.

* * * * *